US006296331B1

(12) United States Patent
Tramontina

(10) Patent No.: US 6,296,331 B1
(45) Date of Patent: Oct. 2, 2001

(54) VANDAL RESISTANT WASHROOM DISPENSER

(75) Inventor: Paul Tramontina, Perkasie, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 512 days.

(21) Appl. No.: 08/951,077

(22) Filed: Oct. 15, 1997

Related U.S. Application Data

(63) Continuation of application No. 08/534,179, filed on Sep. 26, 1995, now abandoned.

(51) Int. Cl.[7] ..... B65H 49/00

(52) U.S. Cl. ..... 312/34.1; 312/34.4; 312/34.7; 312/245; D6/518

(58) Field of Search ..... 312/34.1, 34.2, 312/34.3, 34.4, 34.5, 34.6, 34.7, 34.8; 242/590, 596.8, 597.8, 598.6; D6/512, 518, 522, 523, 542, 545

(56) References Cited

U.S. PATENT DOCUMENTS

| | | | | |
|---|---|---|---|---|
| D. 312,369 | * | 11/1990 | De Luca et al. | D6/518 X |
| D. 332,196 | * | 1/1993 | Hines | D6/518 X |
| D. 332,889 | * | 2/1993 | Hines | D6/518 |
| D. 354,871 | * | 1/1995 | Frazier et al. | D6/522 |
| 1,339,823 | | 5/1920 | Harbaugh . | |
| 1,423,336 | * | 7/1922 | Korittke | 312/34.8 X |
| 1,568,901 | | 1/1926 | Mickey . | |
| 2,229,596 | | 1/1941 | Eilers . | |
| 2,560,061 | * | 7/1951 | Agamaite, Jr. | 312/34.8 X |
| 2,726,825 | * | 12/1955 | Ziskin et al. | 242/596.8 X |
| 2,883,254 | | 4/1959 | Bacca | 312/242 |
| 2,946,636 | | 7/1960 | Penney . | |
| 3,095,249 | | 6/1963 | Albrecht | 312/242 |
| 3,147,051 | | 9/1964 | Birr et al. . | |
| 3,222,112 | | 12/1965 | Bahnsen . | |
| 3,510,055 | | 5/1970 | Safford . | |
| 3,603,519 | | 9/1971 | Brown et al. | 242/594.1 |
| 3,797,769 | | 3/1974 | Tucker | 242/55.53 |
| 3,843,218 | | 10/1974 | Krueger et al. . | |
| 3,851,941 | | 12/1974 | Stebe | 312/333 |
| 3,865,323 | * | 2/1975 | Stronge et al. | 312/34.8 X |
| 3,869,183 | | 3/1975 | Frank, Jr. | 312/248 |
| 3,920,297 | | 11/1975 | Brandes | 312/217 |
| 3,971,237 | | 7/1976 | Rasmussen | 70/99 |
| 3,998,308 | | 12/1976 | Yeakley | 194/10 |
| 4,047,775 | | 9/1977 | Wolbrink | 312/211 |
| 4,143,792 | | 3/1979 | Rex | 221/97 |
| 4,223,965 | | 9/1980 | Palandrani | 312/100 |
| 4,383,377 | | 5/1983 | Crafton | 34/60 |
| 4,408,811 | | 10/1983 | Richardson et al. . | |
| 4,410,221 | | 10/1983 | Vallis et al. . | |
| 4,611,768 | * | 9/1986 | Voss et al. | 242/598.6 X |
| 4,641,898 | | 2/1987 | Horowitz et al. | 312/209 |
| 4,915,257 | | 4/1990 | Bailey | 221/48 |
| 5,014,985 | | 5/1991 | Capps | 273/32 R |
| 5,125,548 | | 6/1992 | Perrin et al. | 225/39 |
| 5,154,496 | * | 10/1992 | Campbell et al. | 312/34.8 X |
| 5,183,182 | * | 2/1993 | Comstock et al. | 222/129 |
| 5,255,885 | | 10/1993 | Iversen | 248/489 |

FOREIGN PATENT DOCUMENTS

| | | | | |
|---|---|---|---|---|
| 250256 | * | 12/1987 | (EP) | 312/34.8 |
| 892041 | * | 3/1944 | (FR) | 312/34.8 |

* cited by examiner

*Primary Examiner*—James O. Hansen

(57) ABSTRACT

An improved vandal-resistant paper towel dispenser for public washrooms includes a mechanism for storing and dispensing paper towels and an outer housing for encasing the mechanism. The outer housing includes a rear mounting surface that is adapted to be secured to a wall, and a shell-like forward surface, connected to the rear mounting surface, for protecting the mechanism from individuals who might have destructive intent. Advantageously, the shell-like forward surface is softly rounded to an extent that it is practically impossible to obtain a handhold on the top or sides of the outer housing, whereby a vandal will be prevented from grabbing the dispenser and pulling it off the wall.

21 Claims, 5 Drawing Sheets

VANDAL RESISTANT WASHROOM DISPENSER

This application is a continuation of application Ser. No. 08/534,179 entitled "Vandal Resistant Washroom Dispensers" and filed in the U.S. Patent and Trademark Office on Sep. 26, 1995, now abandoned. The entirety of this Application is hereby incorporated by reference.

BACKGROUND OF THE INVENTION

1. Field of the Invention

This invention relates broadly to the field of dispensers for dispensing personal hygiene products, such as paper towels, toilet tissue and hand soap, in a public washroom. More specifically, this invention relates to a dispenser that is specifically designed to deter and escape damage from potential vandals.

2. Description of the Prior Art

Vandalism in public restrooms is an increasingly serious problem for property owners, consumers and maintenance personnel in the United States and throughout the world. All too often, dispensers for paper towels, toilet tissue and hand soap such as those manufactured and sold by the assignee of this invention, Scott Paper Company, are targets for such activity. Paper towel dispensers, in particular, in some locations are regularly beaten, burned, defaced with graffiti, and pulled or pried off of the wall, rendering them inoperable for others. In addition, vandals will pull clumps of paper towels out of the dispenser, scattering them about the washroom or, even worse, stuffing them into toilets or sink fixtures.

Unfortunately, damaged or inoperative dispensers are expensive to replace, and, ironically, their replacements present attractive new targets to vandals once installed. Additionally, the institutions that suffer most from vandalism are often underfunded and in a poor position to be buying washroom fixtures and dispensers on a frequent basis.

A long and unfilled need exists for a public restroom dispenser that will deter and resist damage from vandalism and careless maintenance personnel.

SUMMARY OF THE INVENTION

It is an object of this invention to provide a public restroom dispenser that will deter and resist damage from vandalism and careless maintenance personnel.

In order to achieve the above and other objects of the invention, an improved vandal-resistant paper towel dispenser for public washrooms includes, according to a first aspect of the invention a system for storing and dispensing paper towels; and an outer housing for encasing the storing and dispensing system, the outer housing including a rear mounting surface that is adapted to be secured to a wall, and a shell-like forward surface, connected to the rear mounting surface, for protecting the storing and dispensing system from individuals who might have destructive intent, the shell-like forward surface being softly rounded to an extent that it is practically impossible to obtain a handhold on the top or sides of the outer housing, whereby a vandal will be prevented from grabbing the dispenser and pulling it off the wall.

According to a second aspect of the invention, an improved vandal-resistant paper towel dispenser for public washrooms includes a system for storing and dispensing paper towels; an outer housing for encasing the storing and dispensing system; an access door defined in the outer housing for loading paper towels into the dispenser; a concealed locking and release mechanism for opening the access door; and a decoy locking mechanism that is at least as visible than the concealed locking and release mechanism, whereby vandals intent on opening the dispenser will be confused.

According to a third aspect of the invention, an improved vandal-resistant washroom product dispenser for public washrooms includes a system for storing and dispensing a washroom product; and an outer housing for encasing the storing and dispensing means, the outer housing comprising a rear mounting surface that is adapted to be secured to a wall, and a shell-like forward surface, connected to the rear mounting surface, for protecting the storing and dispensing system from individuals who might have destructive intent, the shell-like forward surface being softly rounded to an extent that it is practically impossible to obtain a handhold on the top or sides of the outer housing, whereby a vandal will be prevented from grabbing the dispenser and pulling it off the wall.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
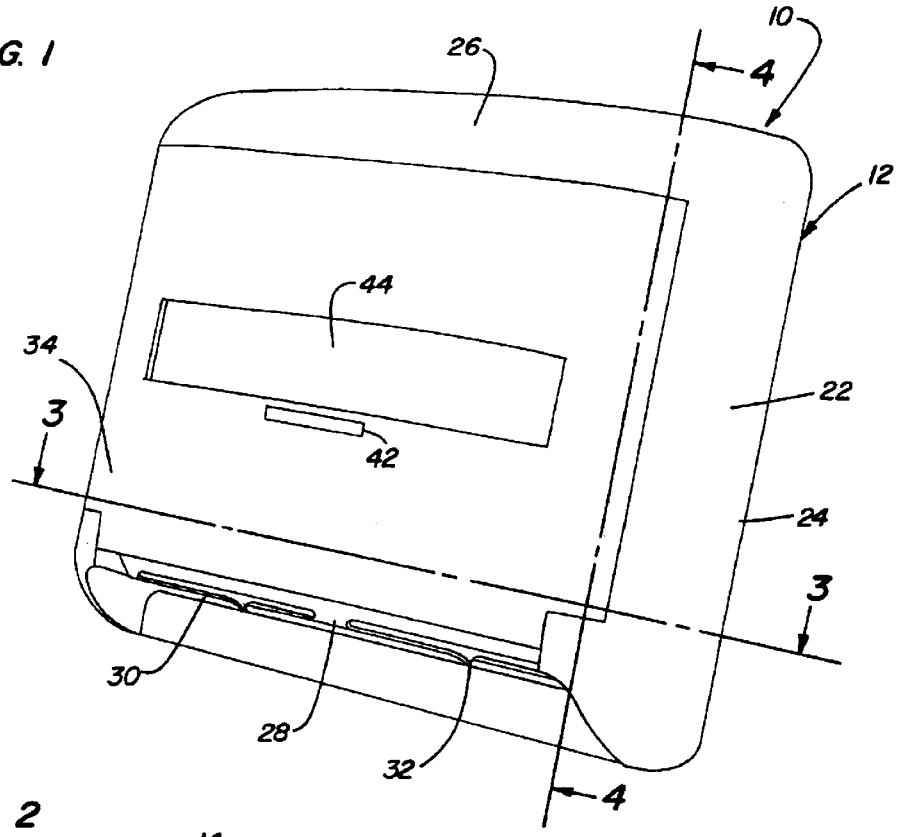
FIG. 1 is a perspective view of an improved vandal resistant paper towel dispenser that is constructed according to a preferred embodiment of the invention.
Figure 2:
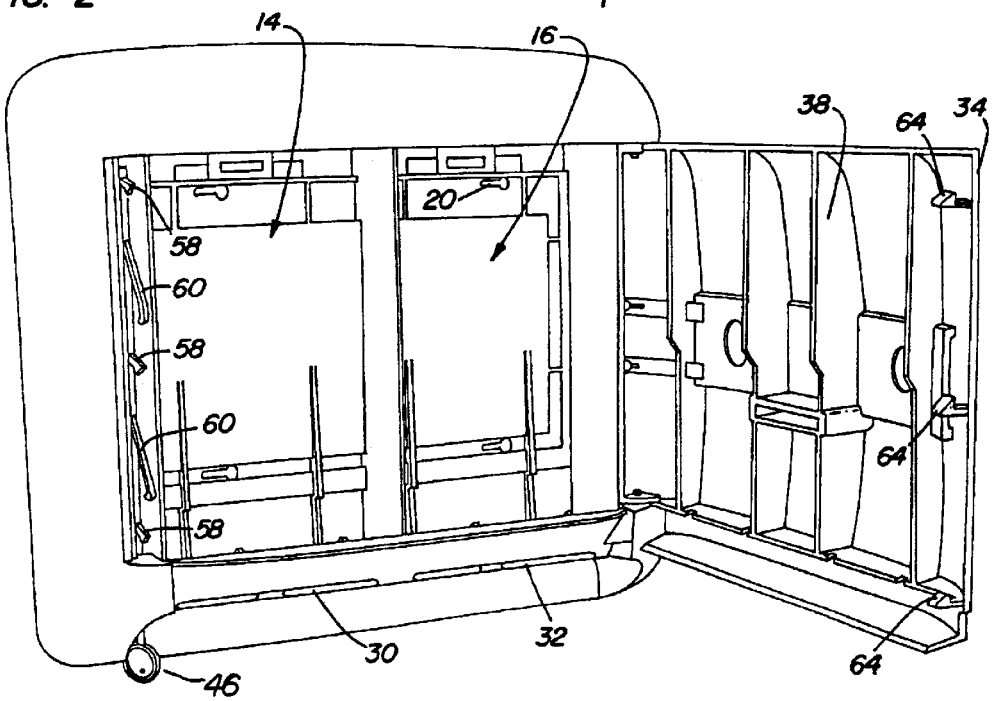
FIG. 2 is a perspective view showing the dispenser of FIG. 1 in an open position.

Referring now to the drawings, wherein like reference numerals designate corresponding structure throughout the views, and referring in particular to FIGS. 1 and 2, an improved vandal resistant paper towel dispenser 10 that is constructed according to a preferred embodiment of the invention includes an outer housing 12 that defines an interior space in which first and second storing and dispensing mechanisms 14, 16 are mounted. As can best be seen in FIG. 3, outer housing 12 includes a rear mounting surface 18 having mounting holes 20 defined therein so as to be securable to a fixed vertical surface, such as the wall of a washroom. According to one particular advantageous aspect of the invention, the outer housing 12 of dispenser 10 includes a shell-like forward surface 22 connected to the rear mounting surface 18, for protecting the storing and dispensing mechanisms 14, 16 from individual who might have destructive intent. As may best be seen in FIG. 1, shell-like forward surface 22 is softly rounded to an extent that it is particularly impossible to obtain a hand hold on the top 26 or side 24 of the outer housing 12. Accordingly, due to the shape of forward surface 22, a vandal would be prevented from grabbing the dispenser 10 and pulling it off the wall.

Figure 6:
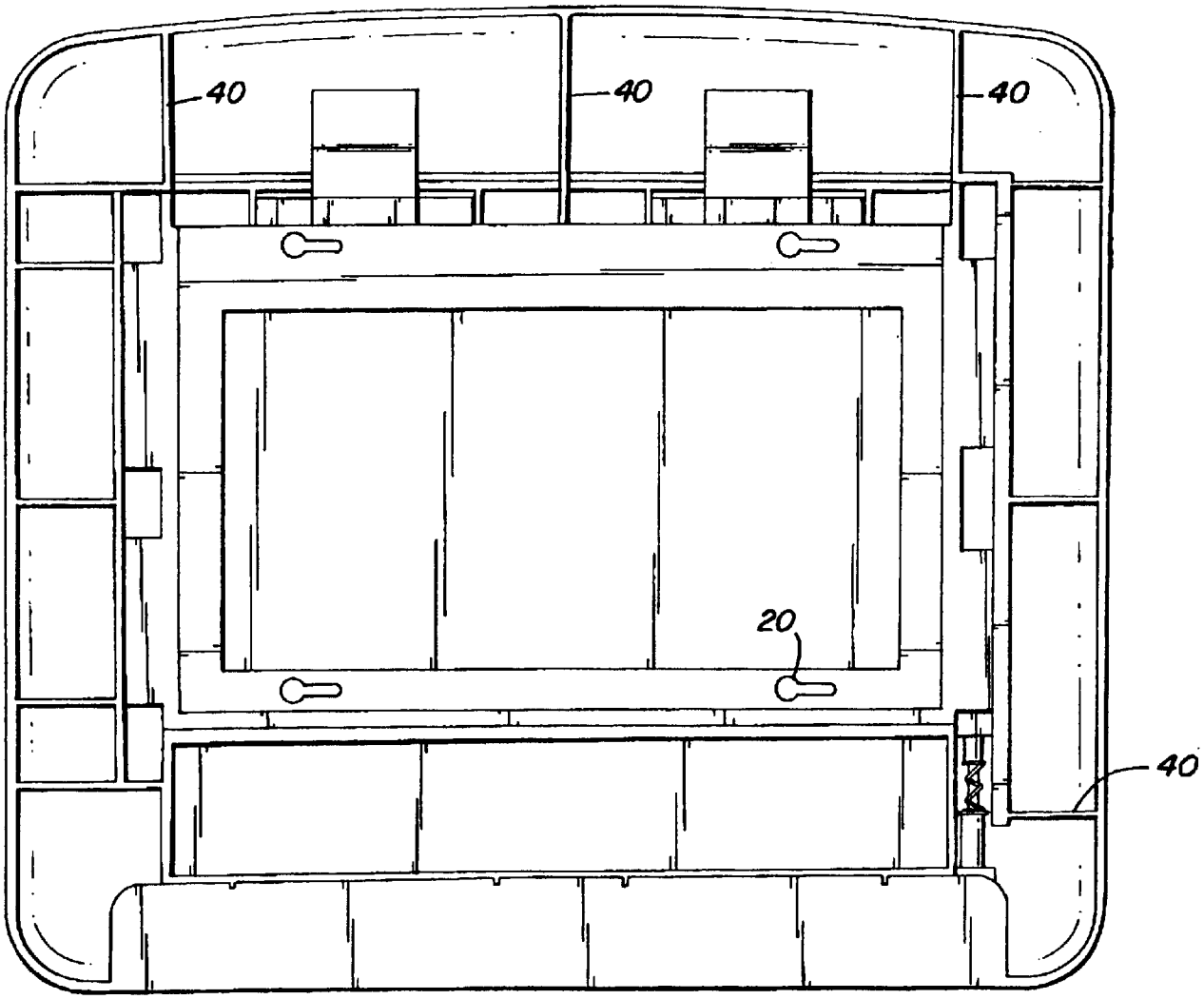
FIG. 6 is a rear elevational view of the dispenser shown FIGS. 1–5.

Dispenser 10 further includes reinforcement of both the shell-like surface 22 and a door 34 that is pivotally mounted to the dispenser 10 and forms part of the outer housing 12. Specifically, as may be seen in FIG. 2, door 34 includes a number of reinforcing ribs 38, and, as may be seen in a rearview of the unit as is depicted in FIG. 6, shell-like forward surface 22 is reinforced by a number of reinforcing ribs 40. Reinforcing ribs 38, 40 function to absorb shock if the dispenser 10 is kicked, punched or bludgeoned.

In addition, the entire outer housing 12, including door 34, is preferably fabricated from a material that is both flame-retardant, so as to resist ignition if a vandal tries to ignite it with a match, cigarette lighter or torch, and that is easy to clean of graffiti as well. Preferably, the material is a polycarbonate-ABS blend, such as that which is available from GE Engineered Plastics under the trademark CYCOLOY. Outer housing 12 is also preferably fabricated from an opaque material so that vandals cannot see inside and therefore be tempted to force the dispenser 10 open.

In an alternative embodiment, only the area about the first and second dispensing orifices 30, 32 at a bottom 28 of the outer housing 12 would be fabricated from the flame-retardant material. Studies have shown that when vandals try to ignite an article such as a towel dispenser, its usually done at the bottom near the dispensing orifices, and it is usually first attempted by lighting the towels that extend downwardly from the respective dispensing orifices 30, 32.

Figure 3:
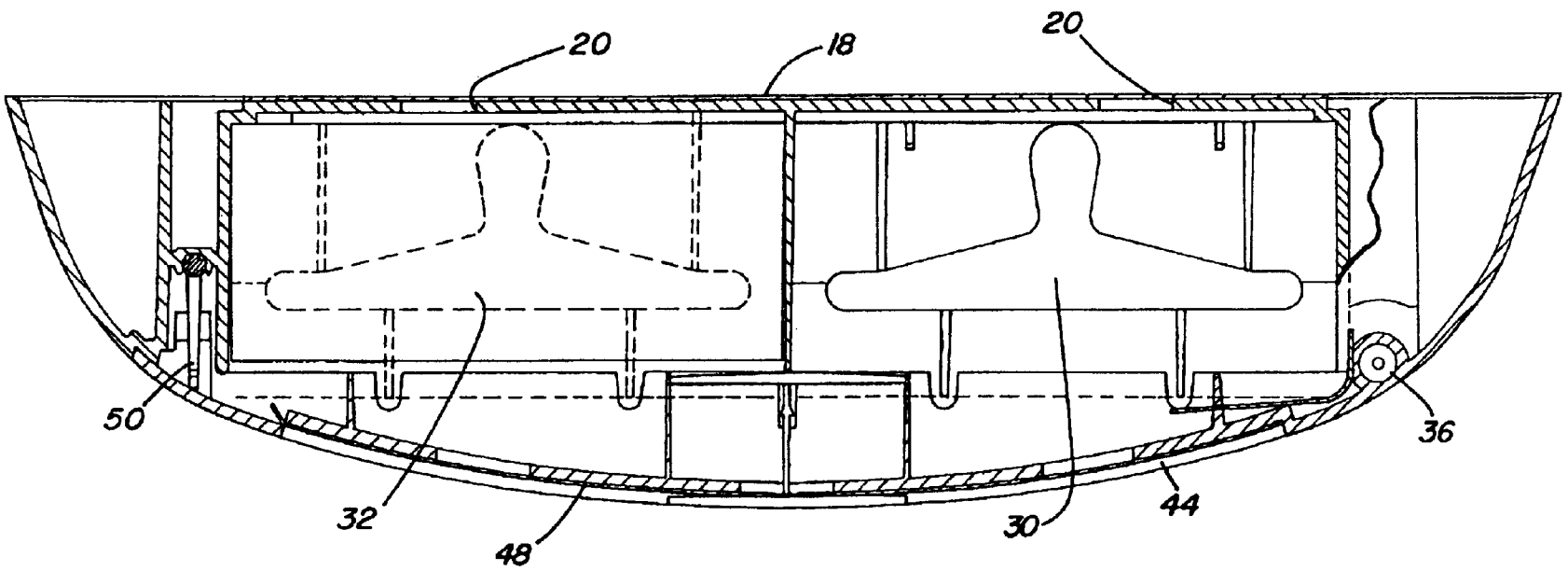
FIG. 3 is a cross-sectional view taken along lines 3—3 in FIG. 1.
Figure 4:
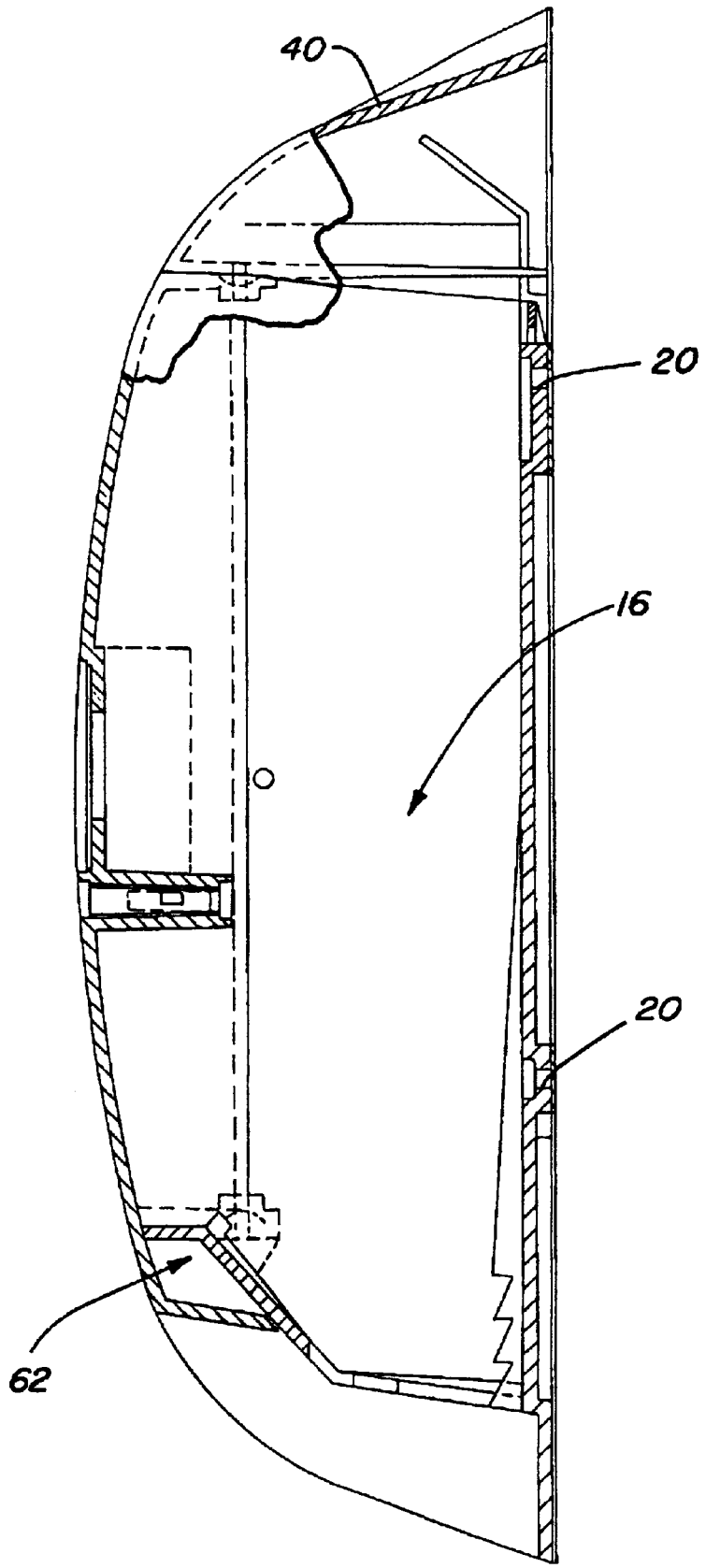
FIG. 4 is a cross-sectional view taken along lines 4—4 in FIG. 1.

Referring now to FIGS. 2 and 3, it will be seen that access door is pivotally mounted to open from one side to another, as opposed to from top to bottom, so that a careless custodian will not have an opportunity to damage the dispenser by hanging on an open door. Moreover, access door 34 has no exposed hinges or handles, so that vandals will have no opportunity to tamper with the door or pry it open. This is achieved by a hidden hinge mechanism 36, best seen in FIG. 3, that is provided entirely within the space defined by outer housing 12 so as not to be visible or accessible from the outside. Door 34 includes a viewing port 42 that is fabricated from a reinforced transparent material and is designed to resist impact without breaking. As is common in many of the dispensers marketed by the assignee of this invention, Scott Paper Company, door 34 has a display window 44 provided thereon that is constructed and arranged so that a decorative strip 48 can be displayed to a user. For example, if the dispenser 10 is in a fast-food restaurant, the display window 44 may include a decorative strip 48 that includes the logo of the restaurant chain.

Figure 5:
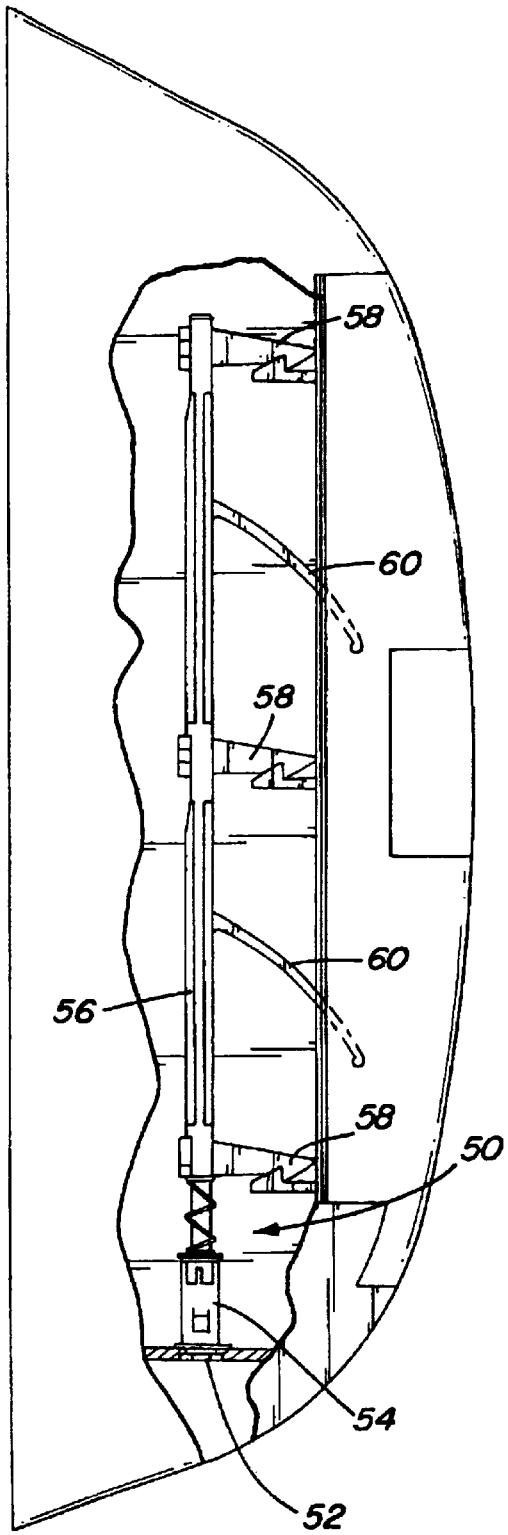
FIG. 5 is a fragmentary view depicting a concealed locking mechanisms in the dispenser shown in FIGS. 1–4.

Dispenser 10 further includes a hidden locking mechanism 50 that is constructed and arranged so that the door 34 may be opened by maintenance personal without the use of any external handles or gripping ports. Specifically, locking mechanism 50 includes a keyed recess 52 that is connected to a camming mechanism 54, as may best be seen in FIG. 5. Camming mechanism 54 is connected to a force-transmitting member 56 that in turn is coupled to a number of latch members 58. A number of spring fingers 60 are provided within the housing 12 to bias the door 34 toward its open position. A number of locking pawls 64 are provided on the door 34 for engaging the corresponding number of latches 58 that are connected to force-transmitting member 56. During normal use, door 64 would be closed, and the latch members 58 will be engaged with the pawls 64 in the manner that is shown in FIG. 5. When a maintenance person wants to open the dispenser 10, he or she will insert a key into the recess 52 and twist, thus moving the force-transmitting member 56 upwardly and disengaging the latches 58 from the respective locking pawls 64. At this point, the spring fingers 60 will force the door 34 open to an extent that the maintenance person will be able to grasp the door and open it the rest of the way.

As a further deterrent to vandals, a second, non-functional decoy locking mechanism 46 is provided conspicuously at the bottom 28 of the outer housing 12, as may be seen in FIG. 2.

In recognition of the fact that the outer housing 12 may be defaced in other ways, the entire outer housing assembly is constructed with double-seams 62 about the door 34 so as to be water resistant when washed. With the double-seam arrangement such as indicated by reference numeral 62, maintenance personal can hose down the dispenser 10 without fear of the paper towels therein becoming wet. A sealing gasket can also be positioned between the seams (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved wall-mounted, vandal-resistant paper towel dispenser for public washrooms, comprising:

means for storing and dispensing paper towels; and an outer housing for encasing said storing and dispensing means, said outer housing comprising a rear mounting surface that is adapted to be secured to a wall, and a shell-like forward surface having a top and sides and which is connected to said rear mounting surface, for protecting said storing and dispensing means from individuals who might have destructive intent, said shell-like forward surface being softly rounded to define a smoothly curving cross-sectional profile in any plane perpendicular to the rear mounting surface to an extent that is practically impossible to obtain a hand-hold on the top or sides of said outer housing, whereby a vandal will be prevented from grabbing the dispenser and pulling it off the wall.

2. A dispenser according to claim 1, further comprising reinforcing means for reinforcing said shell-like outer surface against deflection and damage as a result of blows that might be imparted thereto by a vandal.

3. A dispenser according to claim 2, wherein said reinforcing means comprises a plurality of reinforcing ribs.

4. A dispenser according to claim 1, wherein said shell-like outer surface comprises a flame-retardant material.

5. A dispenser according to claim 1, wherein said shell-like outer surface comprises a material that is easy to clean of graffiti.

6. A dispenser according to claim 1, further comprising an access door defined in said shell-like outer surface.

7. A dispenser according to claim 6, wherein said access door has no exposed hinges or handles, whereby vandals will have no opportunity to tamper with said door.

8. A dispenser according to claim 6, wherein said access door is hinged to open from one side to another, as opposed to from top to bottom, whereby a careless custodian will not have an opportunity to damage the dispenser by hanging on the open door.

9. A dispenser according to claim 6, wherein seams between said access door and said shell-like outer surface are configured to be water-resistant, whereby the dispenser may be cleaned by hosing it down without damaging any product stored therein.

10. A dispenser according to claim 1, wherein said shell-like outer surface is opaque, whereby vandals cannot see therein.

11. A dispenser according to claim 6, further comprising a concealed locking and release mechanism for opening said access door.

12. A dispenser according to claim 11, further comprising a decoy locking mechanism that is more easily visible than said concealed locking and release mechanism, whereby vandals intent on opening the dispenser will be confused.

13. A dispenser according to claim 1, wherein said shell-like outer surface is corrosion-resistant, whereby the dispenser may be cleaned by hosing it down without damaging the dispenser.

14. An improved vandal-resistant paper towel dispenser for public washrooms, comprising:

means for storing and dispensing paper towels;

an outer housing for encasing said storing and dispensing means;

an access door defined in said outer housing for loading paper towels into the dispenser;

a concealed locking and release mechanism for opening said access door; and a decoy locking mechanism that is at least as visible than said concealed locking and release mechanism, whereby vandals intent on opening the dispenser will be confused.

15. An improved wall-mounted, vandal-resistant washroom product dispenser for public washrooms, comprising:

means for storing and dispensing a washroom product; and an outer housing for encasing said storing and dispensing means, said outer housing comprising a rear mounting surface that is adapted to be secured to a wall, and a shell-like forward surface having a top and sides and which is connected to said rear mounting surface, for protecting said storing and dispensing means from individuals who might have destructive intent, said shell-like forward surface being softly rounded to define a smoothly curving cross-sectional profile in any plane perpendicular to the rear mounting surface to an extent that is practically impossible to obtain a hand-hold on the top or sides of said outer housing, whereby a vandal will be prevented from grabbing the dispenser and pulling it off the wall.

16. A dispenser according to claim 15, further comprising reinforcing means for reinforcing said shell-like outer surface against deflection and damage as a result of blows that might be imparted thereto by a vandal.

17. A dispenser according to claim 16, wherein said reinforcing means comprises a plurality of reinforcing ribs.

18. A dispenser according to claim 15, wherein said shell-like outer surface comprises a flame-retardant material.

19. A dispenser according to claim 15, wherein said shell-like outer surface comprises a material that is easy to clean of graffiti.

20. A dispenser according to claim 15, wherein said shell-like outer surface is opaque, whereby vandals cannot see therein.

21. A dispenser according to claim 15, wherein said shell-like outer surface is corrosion-resistant, whereby the dispenser may be cleaned by hosing it down without damaging the dispenser.

* * * * *